United States Patent [19]

Wunderlich

[11] 4,133,745

[45] Jan. 9, 1979

[54] PROCESSING SHALE OIL CUTS BY HYDROTREATING AND REMOVAL OF ARSENIC AND/OR SELENIUM

[75] Inventor: Donald K. Wunderlich, Richardson, Tex.

[73] Assignee: Atlantic Richfield Company, Los Angeles, Calif.

[21] Appl. No.: 912,817

[22] Filed: Jun. 5, 1978

Related U.S. Application Data

[63] Continuation-in-part of Ser. No. 825,792, Aug. 18, 1977, abandoned.

[51] Int. Cl.[2] ..... C10G 23/02

[52] U.S. Cl. ..... 208/254 H

[58] Field of Search ..... 208/210, 254 H, 254 R, 208/251 R, 251 H

[56] References Cited

U.S. PATENT DOCUMENTS

| | | | |
|---|---|---|---|
| 3,025,230 | 3/1962 | MacLaren | 208/210 |
| 3,306,845 | 2/1967 | Poll | 208/210 |
| 4,029,571 | 6/1977 | Curtin | 208/251 H |
| 4,069,140 | 1/1978 | Wunderlich | 208/251 H |
| 4,090,951 | 5/1978 | Smith | 208/254 H |

*Primary Examiner*—George Crasanakis

*Attorney, Agent, or Firm*—Roderick W. MacDonald

[57] ABSTRACT

A method for processing shale oil to remove both nitrogen and impurities such as arsenic and/or selenium while minimizing such removal costs which comprises fractionating the shale oil feet to form a first naphtha cut which essentially boils at or below 350° F and a gas oil cut which essentially boils above 350° F, hydrotreating the first naphtha cut, separately removing a substantial amount of said impurity from the gas oil cut and then hydrotreating the gas oil cut. Thereafter the hydrotreated gas oil cut is fractionated to form a second naphtha cut which essentially boils above 380° F and at or below 450° F and has a high nitrogen content, and hydrotreating the second naphtha cut to reduce the nitrogen content.

4 Claims, 1 Drawing Figure

PROCESSING SHALE OIL CUTS BY HYDROTREATING AND REMOVAL OF ARSENIC AND/OR SELENIUM

CROSS REFERENCES TO RELATED APPLICATIONS

This is a continuation-in-part of U.S. Application Ser. No. 825,792, filed Aug. 18, 1977 and now abandoned.

BACKGROUND OF THE INVENTION

Raw shale oil sometimes contains nitrogen or nitrogen containing compounds, all hereinafter collectively referred to as "nitrogen", and/or impurities such as arsenic and/or selenium and compounds of arsenic and/or selenium, all hereinafter collectively referred to as "impurity" or "impurities". Both nitrogen and impurities are desirably removed or at least minimized in the final shale oil product.

It can be expensive to remove nitrogen and impurities and therefore it is highly desirable to remove the maximum amount of nitrogen and impurities at minimum processing expense.

SUMMARY OF THE INVENTION

It has been found that if in fractionating the raw shale oil feed the fractionation is carried out so that a first naphtha cut is formed which essentially boils at or below 350° F., preferably at or below 300° F., and if the hydro-treated raw gas oil cut from such a fractionation, after impurity removal, is fractionated so that a second naphtha cut is generated which essentially boils at or below 425° F., preferably at or below 450° F., and the second naphtha cut is hydrotreated, for example along with the hydrotreatment of the first naphtha cut, a product naphtha and product gas oil are generated which are adequately low in nitrogen and impurities and which can be employed separately or combined to produce a final product suitable for use as such or other processing or transportation as desired.

BRIEF DESCRIPTION OF THE DRAWING

The drawing shows one process embodying the invention of this process wherein first and second naphtha cuts according to the requirements of this invention are generated and hydrotreated together, while the gas oil cut is separately treated for impurity removal and hydrotreating.

DETAILED DESCRIPTION OF THE INVENTION

Figure 1:
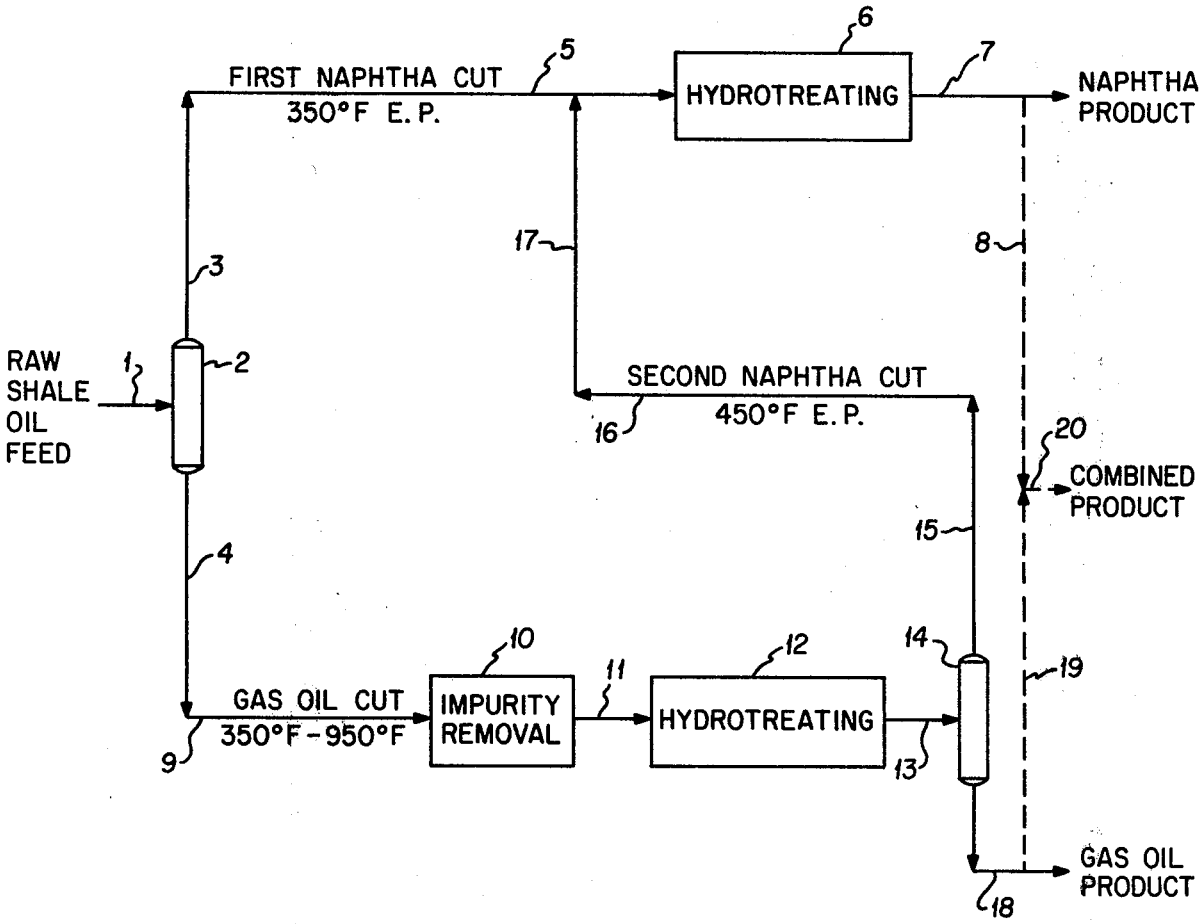

More specifically, the drawing shows raw shale oil feed from a retort or other shale oil generation source in pipe 1 passing to fractionator 2. The raw shale oil feed generally contains nitrogen and impurities which vary widely, but generally will be, based on the total weight of the raw shale oil feed, at least 2.0 weight percent nitrogen and at least 50 ppm (parts per million) impurities.

In fractionator 2 the raw shale oil feed is split into a first naphtha cut which is recovered overhead by way of pipe 3, a gas oil cut which is recovered by way of pipe 9, and a bottoms cut which is recovered by way of pipe 4. The fractionator is operated so that the first naphtha cut contains materials which essentially all boil below 350° F. (e.g., pentane to 350° F.), preferably below 300° F., the gas oil cut contains essentially only materials which boil at temperatures greater than 350° F., preferably greater than 300° F. up to about 950° F., and the bottoms cut contains essentially only materials which boil at temperatures greater than 950° F.

The first naphtha cut is transported by way of pipe 5 to a conventional hydrotreating step 6 which is well known in the art and which is operated so as to saturate a substantial amount of unsaturated hydrocarbons present in the naphtha cut and at the same time remove nitrogen originally present in the naphtha feed to unit 6. It has been found that by fractionating the shale oil feed in the manner just described the first naphtha cut will contain essentially no impurities, such impurities having been concentrated in the gas oil cut. This eliminates the need for, and therefore the expense of, a special impurities removal step such as unit 10 prior to hydrotreater 6. The output of hydrotreater 6 in pipe 7 is a naphtha product useful for transportation or other use on its own or for combination by way of dotted line 8 with the gas oil product hereinafter described.

The gas oil cut which contains substantial amounts of impurities is transferred by way of pipe 9 to an impurity removal step 10 wherein impurities are removed by known methods such as treatment with a catalyst designed for the removal of such impurities on the catalyst, caustic treating, and so forth as is known in the art. The impurity removal step adds cost to the process and therefore the elimination of the need for an impurity removal step for both naphtha cuts of this process is a cost saving innovation.

The treated gas oil or cut is removed from unit 10 by way of pipe 11 and passed to a hydrotreating step 12 which is carried out at more severe conditions than step 6 since the gas oil cut, being of higher boiling range, is more difficult to denitrogenate than the relatively low-boiling naphtha. Also, since the gas oil contains essentially all of the impurities in the 950° F. minus material, an impurity removal stage is required ahead of hydrotreater 12.

The hydrotreated gas oil cut from unit 12 is then passed by way of pipe 13 into fractionator 14 which is operated at conditions such that a second naptha cut is generated and recovered overhead by way of pipe 15, the second naphtha cut containing essentially only materials which boil above 380° F. and at or below 450° F., preferably above 380° F. and at or below 425° F. It has been found that by operating fractionator 14 in a manner such that the above described second naphtha cut is achieved, e.g., use in a conventional reformer, the second naphtha cut is too high in nitrogen for a commercial product, but the nitrogen content can be reduced to an acceptable level by hydrotreating under conditions less severe than those found in unit 12. For example, the second naphtha cut can be passed by way of pipes 16 and 17 to pipe 5 where it is mixed with first naphtha cut material and the mixture lightly hydrotreated together in unit 6. The material recovered as bottoms from fractionator 14 in pipe 18 is gas oil product which can be used separately or combined by way of dotted line 19 to produce a combined full range product in line 20.

Making the second naphtha cut deeper than 380° F. and as deep as 450° F., as opposed to 350° F. for the first cut, makes a wider range naphtha cut that is free of nitrogen which gives downstream processors such as refiners a wider nitrogen free working area if such processors decide to produce their own special naphtha product therefrom. Applicant's deep naphtha cut is a true naphtha cut and not just a combination of naphtha and diesel cuts since a normal diesel cut goes much deeper, e.g., up to 625° F.

The impurity removal process of step 10 and the hydrotreating processes of steps 6 and 12 are known in the art. For example, suitable impurity removal and hydrotreating details are fully and completely disclosed in U.S. Pat. No. 3,954,603, the disclosure of which is incorporated herein by reference.

The particular operating conditions of steps 6, 10, and 12 will vary widely depending upon the particular type of feed material in pipe 1, its source, its composition, and the like as well as the desired characteristics of the naphtha and/or gas oil product to be produced. Therefore specific operating conditions or even ranges of operating conditions will vary widely and are impossible to categorize without unduly limiting the flexibility of the inventive concept. However, by operating the overall process and the various steps in the process to meet the required boiling points set forth hereinabove for the various cuts, a final shale oil product, whether primarily only naphtha or primarily only gas oil or a combination thereof, will have at least 90 weight percent less nitrogen and essentially 100 weight percent less impurity (both based on the weight of the original shale oil feed) than that originally found in the raw shale oil feed in pipe 1.

EXAMPLE

The process is carried out substantially in the manner set forth in the drawing wherein the shale oil feed containing 2.0 weight percent nitrogen and 50 ppm arsenic, both based on the total weight of the feed, is passed to fractionator 2 which is operated to produce an overhead cut with a nominal end point of 425° F. and autogenous pressures to produce an overhead naphtha cut which ranges in boiling point from the initial boiling point of the feed to 325° F. end point and a bottoms gas oil cut which has a boiling range from greater than 325° F. to 950° F. The naphtha cut is lightly hydrotreated in unit 6 using hydrotreating conditions with molecular hydrogen of about 750° F., 1000 psig and a weight hourly space velocity of 1.5 pounds of naphtha cut feed per pound of nickel-molybdenum catalyst per hour. The naphtha product in pipe 7 from unit 6 and the naphtha cut in unit 5 contains essentially no arsenic or nitrogen.

The gas oil cut is treated for arsenic removal substantially in the manner set forth in said U.S. Pat. No. 3,954,603 whereby the arsenic content of the gas oil cut is reduced from 50 ppm arsenic in pipe 9, based on the total weight of the gas oil cut in pipe 9, to 2 ppm in pipe 11 based on the total weight of the gas oil cut in pipe 11.

The gas oil cut after treatment for arsenic removal is subjected to more severe hydrotreating conditions in unit 12 than obtained in unit 6, i.e., subjecting the gas oil feed to molecular hydrogen at a temperature of about 750° F., 2000 psig, and a weight hourly space velocity of 2.4 pounds of gas oil feed per pound of nickel-molybdenum catalyst per hour. The hydrotreated gas oil cut in pipe 13 contains 0.04 weight percent nitrogen and 0 ppm arsenic based upon the total weight of the gas oil cut in pipe 13.

Fractionator 14 is run to produce a second overhead naphtha cut with a nominal end point of 425° F. at autogenous pressures. The second naphtha cut contains 50 ppm nitrogen based on the total weight of that cut and essentially no arsenic. This cut is mixed with the first naphtha cut in pipe 5 and subjected to hydrotreating in unit 6 wherein the nitrogen content of the second naphtha cut is reduced to the content mentioned hereinabove with respect to the naphtha product in pipe 7.

The bottoms product of fractionator 14 is a gas oil product which contains 0.05 weight percent nitrogen based upon the total weight of the product and no measurable arsenic.

Reasonable variations and modifications are possible within the scope of this disclosure without departing from the spirit and scope of this invention.

The embodiments of the invention in which an exclusive property or privilege is claimed are defined as follows:

1. A method for processing shale oil which contains nitrogen and at least one impurity selected from the group of arsenic and selenium comprising fractionating the shale oil feed to separate a first naphtha cut which essentially boils at or below 350° F. and a gas oil cut which essentially boils above 350° F., hydrotreating said first naphtha cut to remove nitrogen and to hydrogenate unsaturates therein, removing a substantial amount of said impurity from said gas oil cut, hydrotreating said gas oil cut after said impurity removal to remove nitrogen from said gas oil cut, fractionating said hydrotreated gas oil cut to separate a second naphtha cut which essentially boils above 380° F. and at or below 450° F. and has a high nitrogen content, and hydrotreating said second naphtha cut with said first naphtha cut to reduce said nitrogen content.

2. The method according to claim 1 wherein said hydrotreated naphtha cuts and said hydrotreated gas oil cut are combined to provide a final product which is low in both nitrogen and said impurity.

3. The method according to claim 1 wherein said shale oil feed is fractionated to provide a first naphtha cut which essentially boils at or below 300° F. and a gas oil cut which essentially boils above 300° F., and said hydrotreated gas oil cut is fractionated to form a second naphtha cut which essentially boils at or below 425° F.

4. The method according to claim 3 wherein said final shale oil product contains, based on the weight of said shale oil feed, at least 90 weight percent less nitrogen than in said shale oil feed and essentially no impurity.

* * * * *